United States Patent [19]

Willi

[11] 4,265,462

[45] May 5, 1981

[54] SUPPORT DEVICE FOR SKIERS

[76] Inventor: Hans-Anton Willi, Gassa Sure 25, 7013 Domat/Ems, Switzerland

[21] Appl. No.: 64,990

[22] Filed: Aug. 9, 1979

Related U.S. Application Data

[63] Continuation of Ser. No. 953,354, Oct. 23, 1978, abandoned, which is a continuation of Ser. No. 855,085, Nov. 28, 1977, abandoned.

[30] Foreign Application Priority Data

Nov. 26, 1976 [CH] Switzerland ..... 14913/76

[51] Int. Cl.[3] ..... A63C 9/00; A63C 3/02

[52] U.S. Cl. ..... 280/11.36; 280/618

[58] Field of Search ..... 280/11.36, 618, 611, 280/617; 36/117, 118, 119, 120, 121

[56] References Cited

U.S. PATENT DOCUMENTS

| | | | |
|---|---|---|---|
| 926,646 | 6/1909 | Eubank, Jr. | 280/11.36 X |
| 4,021,053 | 5/1977 | Willi | 280/11.36 |
| 4,058,326 | 11/1977 | Faulin | 280/11.36 X |

FOREIGN PATENT DOCUMENTS

| | | | |
|---|---|---|---|
| 296843 | 2/1972 | Austria | 280/11.36 |
| 471551 | 6/1969 | Switzerland | 36/118 |

*Primary Examiner*—John J. Love
*Assistant Examiner*—Milton L. Smith
*Attorney, Agent, or Firm*—Larson, Taylor and Hinds

[57] ABSTRACT

Support devices for the shanks of skier's legs wherein levers on opposite sides of and parallel to the shank are pivoted about an axis at ankle height and secured to the shank just beneath the knee by a flexible strap. Two rods are pivoted to the lever arrangement on each side. In the case of a single lever the rods are pivoted above and below the lever axis. For parallel levers one rod is pivoted above the axis of one lever and the other rod below the axis of the other lever. In each case the rods pass through a resilient compressible block. When the shank swings forward a stop on one rod compresses the block, while the other rod moves freely in the opposite direction. When the shank swings backward the roles of the rods are reversed.

19 Claims, 7 Drawing Figures

SUPPORT DEVICE FOR SKIERS

This is a continuation of application Ser. No. 953,354 filed 10-23-78, which in turn is a continuation of Ser. No. 855,085 filed 11-28-77, both now abandoned.

FIELD OF THE INVENTION

The invention relates to a support device for skiers which is connectable to a ski or to the ski by way of the ski boot, embraces the shank of the skier's leg in the upper calf region and is deflectable in the longitudinal direction of the skis against the force of a spring device about a lever pivot point lying approximately at ankle height.

DESCRIPTION OF THE PRIOR ART

Support devices for skiers are known and usual in various forms. The reason for the need for such support devices is that the increasing performance demands in ski sport lead to corresponding increasing demands on the equipment.

As well as the skis themselves, this relates above all to the bindings and the ski boots, the function of which as pure foot coverings was long abandoned. The ski boots used today serve primarily to shift the force transmission to the ski from the foot of the skier to a zone lying above the ankle. At the same time the danger of ankle fractures has to be reduced by stiffer ski boots.

The ski boots used today in fact reduce the danger of fatigue and give the skier better scope of action upon the ski, but also involve the danger of tibia fractures and fibula fractures or what are called bootleg edge fractures. Moreover the ski boots used today block the calf muscles, so that their possibilities of movement are greatly restricted. These problems arise primarily because in the development of ski boots, contradictory demands are made on the designer—on the one hand, the boot should be so flexible that, as far as possible, an anatomically natural movement of the legs is possible and at the same time the most extensive possible ridigity has to be provided to improve the force transmission to the ski.

As already mentioned, to solve these problems various support devices have already been proposed which either can be fitted on the ski in addition to the ski boot or are installed directly in a ski boot.

Thus, by way of example, Swiss Pat. Specification No. 471,551 shows a ski boot having a rigid upper extending into the calf zone, which is intended to distribute the bending forces occurring on tilting of the skis to the whole of the shank of the leg. This ski boot has the disadvantage that it makes the movement in the longitudinal direction of the skis much more difficult and moreover that it does not permit individual adjustment of the forwardly and rearwardly acting spring forces.

Other known support devices propose the use of a lever which is arranged either before or behind the shank of the leg. The consequence of this is that the high forces exerted by the shank are conducted unequivocally into the ski in the longitudinal direct on only. Every force component which is directed slightly obliquely of the ski is transmitted only in an undefined manner by the relatively long lever, and furthermore it has to be taken into consideration that the force acting from beneath upon a ski edge itself acts upon the lever through a lever arm extending to the point of attachment of the lever, so that the lever force of the support lever is reduced. Moreover, in practical experiments it has appeared that the arrangement of the support lever before or behind the shank of the leg greatly increases the danger of accident in collisions, since in this case the fibula or the tibia as the case may be is pressed firmly against the rigid lever. Moreover in the case of rigid formation of the lever the mobility of the skier is greatly restricted, which is felt to be troublesome and obstructive. In particular lateral movements of the shank of the leg and forces acting on the lever obliquely of the longitudinal axis of the skis are felt to be undefined and, especially in the case of use of rigid yoke pieces to retain the shank, involve unpleasant pressure phenomena and undefined reactions due to the ski.

The spring devices used in known support devices also cause problems. In experiments carried out in relation to the present invention it has in fact appeared that on the one hand relatively high forces act upon the support device, but that on the other hand it is indispensible to render possible an exact setting and adjustment of the forces. Moreover in this case it has to be taken into consideration that different forces are to be taken up in the forward and rearward positions, and that the "zero" position should be adjustable.

None of the known spring devices satisfies these demands and furthermore it has appeared that most of the known spring devices are impaired in function or even set completely out of operation by the actions of snow and ice in skiing.

SUMMARY OF THE INVENTION

It is the problem of the invention to avoid the disadvantages of the prior art, that is to say especially to produce a support device with which the force transmission to the skis is rendered possible with reduced expenditure of force with simultaneously improved freedom of movement and reduced danger of accident. Moreover the mechanical expense is to be reduced to a minimum and the spring device is to be simplified and made more easily adjustable and trouble-proof. According to the invention this problem is solved in that the support device comprises two lever arrangements which are pivotable on the two sides of the shank of the leg approximately parallel therewith, each of which arrangements being connected with a spring device. As can be seen each of the lever arrangements conducts a force component acting transversely of the ski on both sides of the ski boot and thus more or less by way of the ski edge into the ski, whereby the force acting upon the ski need comprise no reinforcing lever. Moreover, a lateral pivoting of the shank will lead to a thrust stressing of the one lever arrangement which is supported by a tension stressing of the other lever arrangement. By the improvement of the lever arrangements per se and the division into two lever arrangements provided on the two sides of the foot, the lever arrangements can be of lighter and more elastic formation which leads to a substantially "freer" skiing sensation and to relief of the calf muscles. At the same time however despite this elastic formation a substantially more direct force transmission to the ski is rendered possible than would be possible by means of a single lever before or behind the shank of the leg. Rotating movements likewise can be transmitted very effectively to the ski through the two lever arrangements with the support device in accordance with the invention. Furthermore the danger of accident is largely reduced since the lever arrangements arranged on both sides, on the one hand, completely take up laterally acting forces and on the other hand obliquely acting forces are more or less completely taken over by the lever arrangements. On the other hand, however, sufficient freedom for easy rotating movements can be left to the shank in the support device itself, in order to reduce the danger of injury to the knee joint.

The arrangement can be realized especially advantageously if the two lever arrangements are connected to the skier's shank merely by a flexible connection element and not by a rigid yoke piece. A strap or band can serve here as connection element. It is however quite especially advantageous if a galosh-type protection part or a covering in the form of an overshoe is used for the connection of the two lever arrangements.

The force transmission in the longitudinal direction too can be improved in accordance with the invention if a separate spring device is provided on each of the two lever arrangements.

The securing of the support device can be realized especially simply in accordance with the invention if a retaining plate is provided which is securable by the front element of the ski binding and if in the heel zone a stirrup piece is arranged which is pressed on to the ski by the ski boot after engagement of the binding. In this way simple fitting and removal of the support device are rendered possible in combination with known an usual ski bindings.

The demand made on spring devices in such support devices can be satisfied with great advantage if at least two force transmission elements are provided for connection between the spring device and the lever arrangement on each side, of which elements one is secured above and one below the lever pivot point on the lever arrangement. Thus on pivoting of the lever arrangement forwards or to the rear in each case force components result which act alternately in the same direction. This renders possible the use of spring devices which act in the same direction and thus possess comparable spring characterisitcs. Moreover the overall arrangement can be realized in an especially space-saving and mechanically simple manner.

The arrangement can be further improved if each spring device comprises at least one spring element acting in one direction, if each lever arrangement acts with at least two force transmission elements on an associated spring element, if furthermore the pivot point of the lever arrangement lies between the two securing points of the force transmission elements, and if each of the force transmission elements is effective only on deflection of the lever arrangement in one of the two directions of pivoting.

In this connection it has proved especially valuable if as a spring device there is provided a compression-stressable resilient body, specially a block of elastic synthetic plastics material which exerts not only a resilient effect but also a damping effect in the case of abrupt stressing. The use of the resilient body per se is regarded as highly desirable.

The force transmission elements which connect the spring device with the lever arrangements can be of especially simple, light and statically determinate formation if only the tension stressing is utlized in every force transmision element and the force transmission element is uncoupled or otherwise relieved in the case of compression stressing. In this connection for example cables or chains can also be used, but the use of tie rods has proved its value especially. In practical realization it is advantageous if the tie rods lead through the spring devices or equally through associated retainers and are provided with only one stop acting in one direction, in such a way that on deflection in one direction the tie rod slides freely in the retainer and on deflection in the other direction the stop on the tie rod abuts on a retainer for the spring device and thus the spring device comes into effect.

So that the support device may also be used for walking on the skis before or after the descent, it is advisable if the force transmission elements for the spring devices are detachably connected with the lever arrangements or otherwise to render possible a separation of lever arrangements and spring devices.

Especially simple mechanical assembly and good stability of the arrangement result if the spring device is arranged in the instep zone of the ski boot.

As may be seen the invention permits an optimum setting of the spring forces in dependence upon the skier or equally in special preparation for a terrain to be travelled. It is possible by adjustment of the force transmission elements, especially of the tie rods between lever arrangements and spring device (for example in the direction of shortening or lengthening) both to achieve an initial stress in one of the two directions and to adjust the zero position in which the support device exerts no forces of any kind upon the shank of the leg.

Furthermore, however, by the selection of the spacing of the securing points of the force transmission elements from the pivot point of the lever arrangement, the charateristics during the deflection of the lever arrangement can be determined. Experiments have shown that it is especially advantageous if the lever distance from the force transmission element acting on rearward stressing is greater than the lever distance from the force transmission element acting on forward pivoting of the lever arrangement.

In this case, as may be seen, an especially simple possibility is obtained of setting by adjustment of the distances from the lever pivot point, for example by pivoting the force transmission elements into selected holes in a plurality of possible fastening holes. Of course alternatively it would also be possible to displace the pivot point of the lever arrangement, for example, by an eccentric, since thus, at the same time, the relative lever arms of the two levers effective for the force transmission elements are varied.

The invention can of course, within the scope of the solution according to the invention, readily be further adapted to the specific demands in the individual case or modified, without thereby departing from the overall scope of the invention.

The technical progress and the inventive content of the invention are guaranteed as may be seen both by the new individual features and also especially by combination and sub-combination of all utilized features.

DESCRIPTION OF THE DRAWINGS

In order that the invention may be clearly understood and readily carried into effect two examples thereof will now be described, by way of example, with reference to the accompanying drawings, in which:-

As shown in FIGS. 1 and 2, a ski boot 2 is secured to a ski 3 by an oridinary commercial safety binding 5 which is not shown in detail in the drawing. A support device 1 is held in front of the boot by a retaining plate 16 secured directly by a binding 5' and the support device is pressed firmly on the ski 3 beneath the heel zone of the boot by means of a stirrup piece 9 on the transverse part of which the sole 17 of the boot presses.

Figure 1:
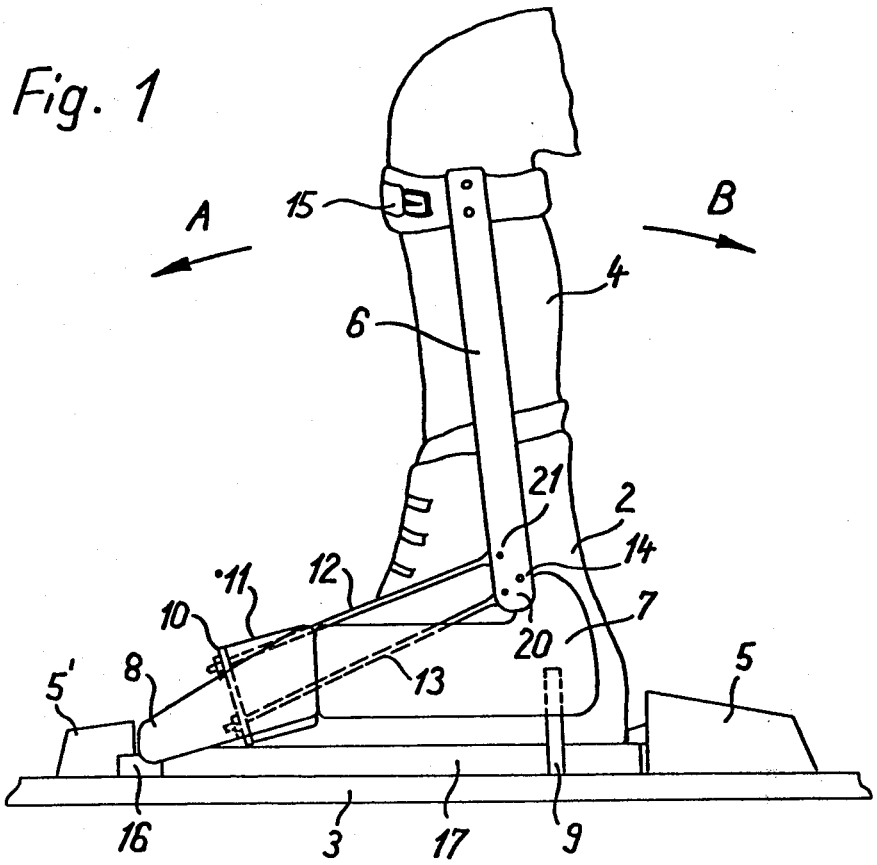
FIG. 1 shows a lateral elevation of a support device.

Two levers 6 and 6' are pivotably connected at coaxial pivot points 14 to mounting plates 7 on opposite sides of the boot. The plates 7 are connected by a curved member 8 by which they are joined to the retaining plate 16. The stirrup piece 9 is likewise secured to the mounting plates 7 so that a frame is provided by which the retention of the entire arrangement on both sides of the boot is guaranteed. The two levers 6 and 6' are connected with one another at their upper end by a leather strap 15 and can be secured by the latter to the shank 4 of the skier. The levers 6 and 6' are made of such length that the securing location lies in the upper section of the shank somewhat below the knee, so that in combination with the overall arrangement an especially advantageous skiing behaviour results.

On the curved member 8 a spring device is provided which consists of a rubber block 11 which can be pressed by a plate 10 elastically and resiliently against an instep plate 18 on the curved member 8. Each of the two levers 6, 6' is connected by means of an upper tie rod 12 and a lower tie rod 13 with the plate 10. The rod 12 is pivoted above and the rod 13 below the axis of the pivot points 14 in mounting bores 21 and 20 respectively. It will be seen that the lower bore 20 is closer to the axis 14 than the upper bore 21.

Figure 2:
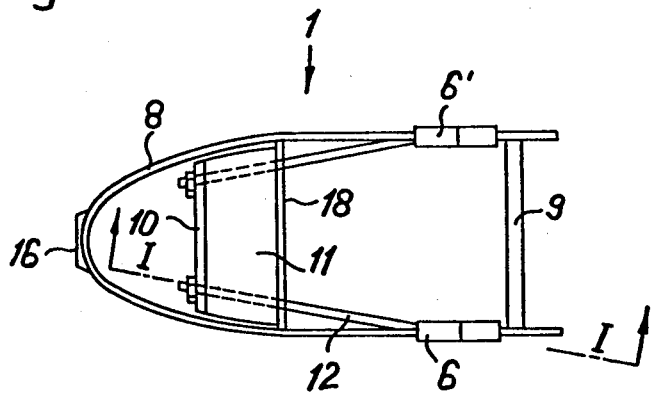
FIG. 2 shows a plan view of a detail of the support device according to FIG. 1.
Figure 3:
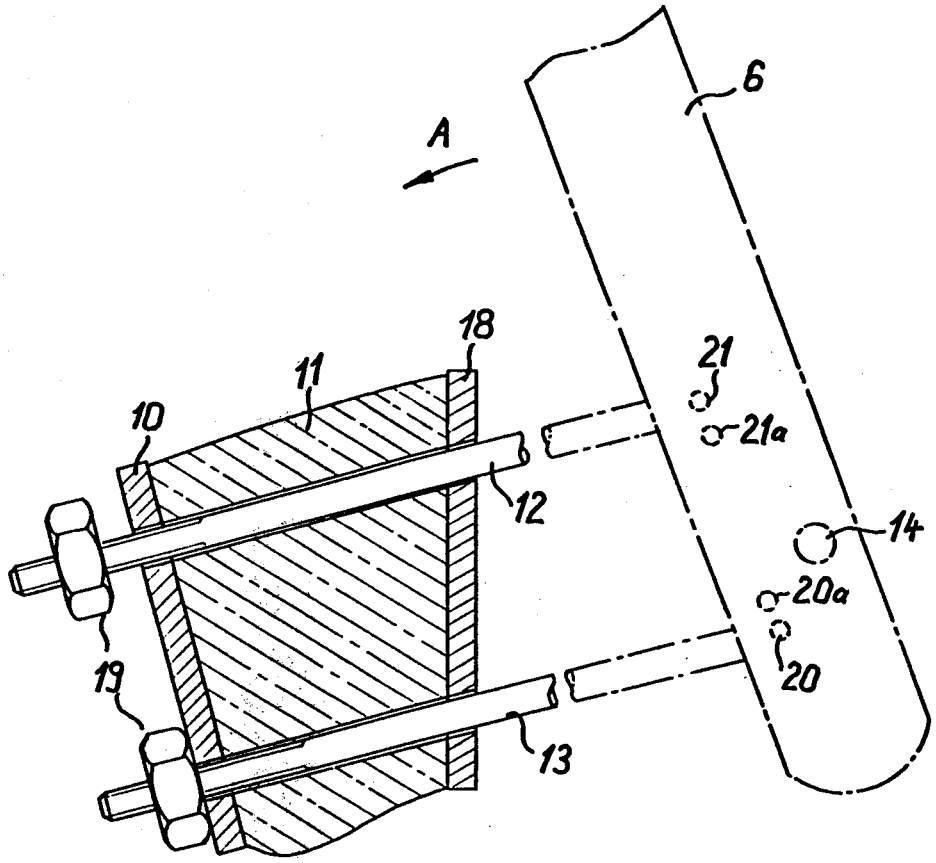
FIG. 3 shows a spring device used in the support device of FIGS. 1 and 2 on an enlarged scale and in section.

As can be seen especially from FIGS. 2 and 3, the two rods 12 and 13 pass through bores in the instep plate 18 and through aligned openings in the rubber block 11 and in the plate 10, and are freely movable in the forward axial direction. It will be understood that the plates 10 and 18 and the rubber block 11 are formed with tunnels through which the toe of the boot passes. Alternatively the block 18 can be divided so as to provide two springs, one for each lever 6 or 6'.

On the other hand, in the case of reverse movement of either rod 12 or 13, a nut 19 adjustably arranged on the rod forms a stop. As may be seen this arrangement results in each rod 12 or 13 being subjected only to tensile stress when it is loaded by the spring device. If in fact the levers 6 and 6' are moved forwards in the direction of the arrow A, the rubber block 11 is compressed by the lower rod 13 between plate 10 and instep plate 18. However, the upper rod 12 in this operation moves freely forward in the axial direction of travel without any resistance (FIG. 3). If however the levers 6 and 6' are moved rearwards in the direction of the arrow B, this leads to a retraction of the tie rod 12, while the tie rod 13 is relieved. As may be seen, by adjustment of the nuts 19 and spring characteristics of the rubber block 11 the entire arrangement can be adjusted and adapted to the requirements of the skier. Moreover, the zero position of the levers 6 and 6' and the initial stress variation which acts immediately on a slight deflection of the levers 6 and 6' can be adjusted. A further possibility of adjustment results from the fact that alternative mounting bores 20*a* and 21*a* may be provided in the levers 6 and 6' as shown in FIG. 3 close to the mounting bores 20 and 21. As may be seen these mounting bores 20*a* and 21*a* are at different distances from the axis 14 of the levers 6 and 6'. By the selection of the mounting bores 21 or 21*a* and 20 or 20*a* for the rods 12 and 13, the effective lever arm can be varied, whereby the overall characteristics of the support device are varied. Such an adaptation can take place especially in dependence upon the size or body weight of the skier or likewise according to the snow conditions (piste or deep snow). The retention of the rods 12 and 13 in the mounting bores 20 or 20*a*, 21 or 21*a* is secured by split pins (not shown), but of course other kinds of retaining elements can be used.

As may be seen the arrangement also permits of separating the two rods 12 and 13 from the spring device either by release of the nuts 19 or by disengagement of the the rods 12 and 13 from the mounting bores 20 or 21, thus rendering comfortable walking possible for the skier. Furthermore, in such a disengaged condition the lever 6 and the lever 6' can be hinged to the rear about the associated axis 14, so that the overall arrangement is less bulky for transport.

Figure 4:
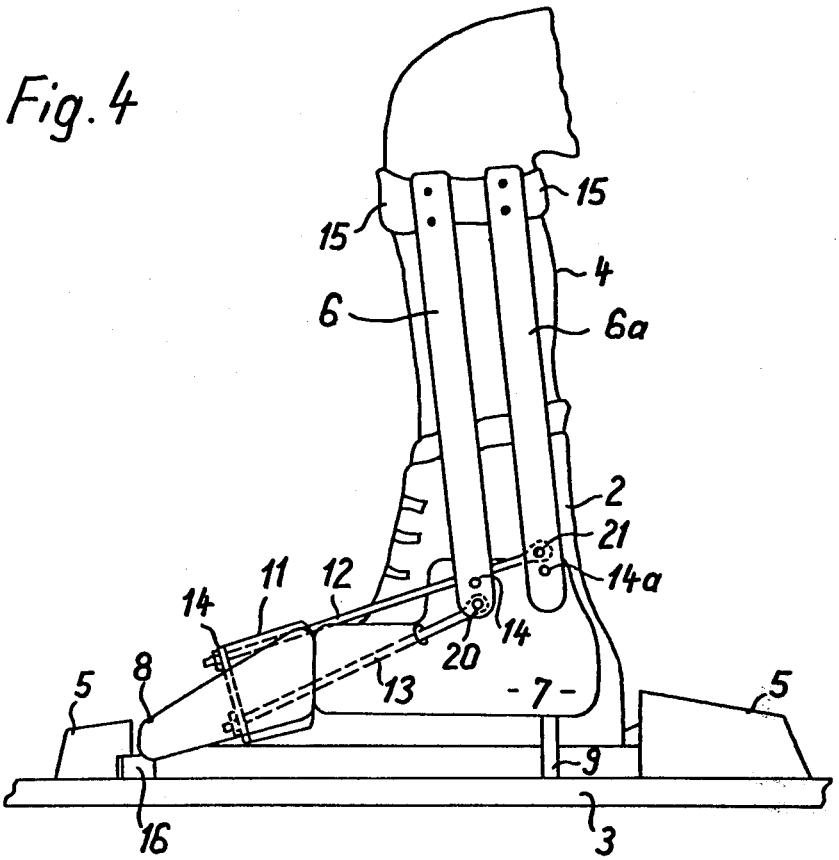
FIG. 4 shows another form of support device.

FIG. 4 shows a modified example in which the lever arrangement consists of two individual levers 6, 6*a* on each side of the skier's leg, which are connected at axes 14, 14*a* with the associated mounting plate 7. Otherwise this example corresponds to the support device according to FIG. 1 and is provided with the same reference numerals for similar parts.

As illustrated the two levers 6, 6*a* on each side of the shank, are connected each only with one pull rod 13 or 12 respectively. The rods 12, 13 are however again arranged on opposite sides of the mounting axes 14, 14*a* so that on deflection of the shank in one direction a tensile stress results in one of the rods and on the deflection of the shank in the opposite direction a tensile stress arises on the other rod. In the forward position this of course leads to the rod 13 being displaced to the rear and the rubber block 11 then resiliently fusing the lever 6. Due to the arrangement of the levers 6 approximately laterally at the level of the tibia, the skier's shank 4 is especially well supported. Moreover the double arrangement of the levers 6 and 6*a* provides an especially good protection of the shank.

While accordingly the lever 6 takes over the force transmission to the ski 3 and the supporting of the shank 4 in forward pivoting movements, in these movements the tie rod 12 slides forward in the described manner through the rubber block 11 and permits the lever 6*a* to pivot freely. However, in the case of a backward position and on pivoting of the shank 4 rearwards, the tie rod 13 is relieved and pushed forward in the described manner through the rubber block 11, while the tie rod 12 is pivoted by the lever 6*a* to the rear about the axis 14*a* and subjected to tension stress, so that in such movements the lever 6*a* resiliently supports the shank 4.

The arrangement is comparably simple in assembly and leads to outstanding force transmission to the ski. Furthermore, the support for the shank by two rearward levers in the case of backward movements and by two forward levers in the case of forward movements is substantially improved. Since moreover the levers are stressed each only in one direction, correspondingly slighter and thus lighter material can be used for the levers 6, 6*a*.

Of course covering the levers 6, 6*a* for example by an elastic cloth covering or by synthetic plastics material is possible, or it is also advantageous to provide the entire support arrangement with a galosh or shoe-type covering in order to keep the snow away from the skier's leg and foot. Since such a covering or protection however has to take over no support effects of any kind, this in no way restricts the freedom of movement of the leg 4 and relatively light and convenient boots can be used beneath it.

Of course the particular configuration of the spring device can be modified in accordance with specific requirements and for example in place of the advantageous block 11 of ordinary rubber it is also possible to use component elements of completely different spring devices, for example, of a metallic, hydraulic or pneumatic nature.

Thus for example it has appeared that in most cases the use of a body or block or buffer of elastic, resilient, synthetic plastics material is still more advantageous than the rubber block described above in connection with the examples. However, even in this case it is advantageous to simplify the assembly by making the synthetic plastics body in one piece, although in specific cases the use of a plurality of separate synthetic plastics spring elements, blocks or buffers is also possible.

Figure 5:
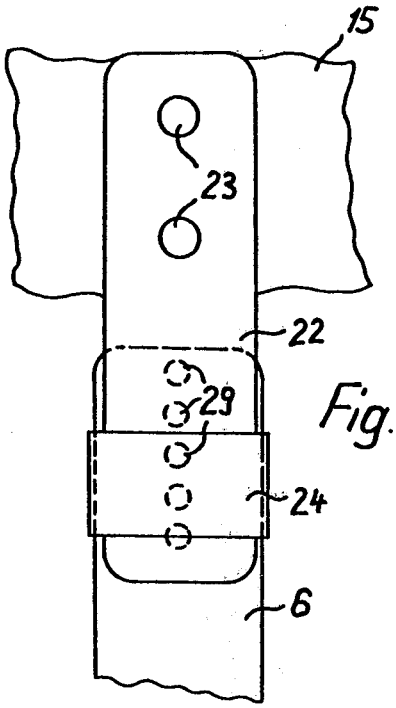
FIG. 5 shows a modification of the suport device of FIG. 1.
Figure 6:
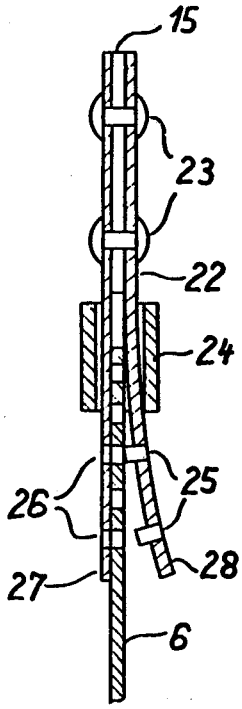
FIG. 6 shows a longitudinal section through the modification of FIG. 5.

FIGS. 5 and 6 show how the upper parts of the levers 6 may be made adjustable. As illustrated, the leather strap 15 is secured by rivets 23 to an end piece 22 of a lever 6. The end piece 22 consists of an inside tongue 27 and an outside tongue 28 in between which the main portion of the lever 6 can be pushed. The outside tongue 28 is provided with two pegs 25 which fit in corresponding bores 26 on the inside tongue 27. The main portion of the lever 6 is likewise provided with bores 29 which conform with the pegs 25 and with the bores 26.

As can be seen a firm connection is produced between end piece 22 and the main portion of the lever 6 as soon as the pegs 25 engage through the bores 29 into the bores 26. The outside tongue 28 is of such resilient formation that it can be bent back in order to render possible a displacement in height of the end piece 22 in relation to the leg.

A securing ring 24, which can be pushed over the pegs 25, holds the tongues 27 and 28 together in the simplest manner and thus prevents unintended disenagement of the connection.

Figure 7:
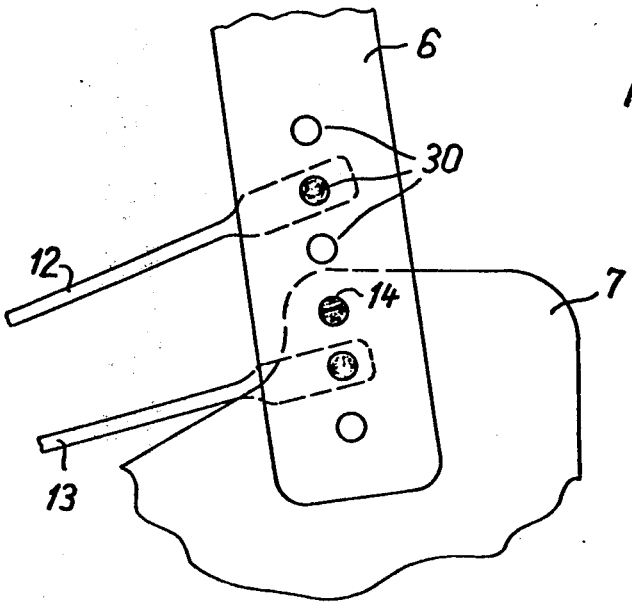
FIG. 7 shows a further modification of the support device of FIG. 1.

Another variant for the height adjustment of the lever 6 is illustrated in FIG. 7. Here the lever 6 possesses several mounting bores 30 which can be used according to choice as the pivot axis 14 for the lever arrangement according to the desired lever length. The same mounting bores 30 also serve for the securing of the rods 12 and 13. Replaceable bolts are preferably used as connection elements.

Adjustability of the effective lever arm can of course also be rendered possible in a different manner. For example, it would also be possible to form the levers as two interengaging tubes or sections which can be relatively displaced telescopically.

Furthermore, it is possible to adapt the mechanism so that the spring device is located behind the ski boot.

I claim:

1. A support device for the shank of a skier's leg comprising a frame adapted to be fixed with respect to a ski and to extend on opposite sides of ski boot, two lever arrangements respectively separately and independently pivoted to opposite sides of said frame in positions to extend along opposite sides of the skier's shank approximately parallel thereto, said lever arrangements being separately pivoted about separate pivot positions approximately at the height of the skier's ankle for said lever arrangements to swing forwards and backwards with respect to the length of the ski, each lever arrangement comprising at least one lever, means for securing said lever arrangements to the skier's shank in the calf region thereof, spring means mounted on said frame and mechanical means interposed between said lever arrangements and said spring means whereby said spring means oppose swinging movement of said lever arrangements both forwards and backwards with respect to a zero position.

2. A support device according to claim 1, in which said means for securing said lever arrangements to the skier's shank comprise a flexible strap for surrounding the skier's shank.

3. A support device according to claim 1, in which said spring means comprise two separate spring devices associated respectively with said two lever arrangements.

4. A support device according to claim 1, in which said frame comprises a retaining plate adapted to be secured to the ski forward of the ski boot by a ski binding, and a stirrup piece having a transverse portion to be pressed onto the ski beneath the heel zone of the ski boot.

5. A support device according to claim 1, in which each said lever arrangement comprises a pair of substantially parallel levers respectively pivoted about two separate axes to said frame, said axes being approximately at the height of the skier's ankle.

6. A support device according to claim 5, in which said mechanical means interposed between said lever arrangements and said spring means operate only to oppose the movement of one lever in each said pair when swinging forwards and the other lever in that pair only when swinging backwards.

7. A support device according to claim 1, in which said mechanical means interposed between said lever arrangements and said spring means comprise two pairs of force transmission elements, one pair for each lever arrangement, the force transmission elements for each lever arrangement being so connected thereto that said spring means only oppose the movement of the lever arrangement in one direction from said zero position through one of said pair of force transmission elements and in the other direction through the other of said force transmission elements.

8. A support device according to claim 7, in which each said lever arrangement comprises one lever pivoted about an axis on said frame and in which said force transmission elements in each pair thereof are pull rods pivoted to the associated lever at points respectively above and below said axis on said frame.

9. A support device according to claim 8, in which said spring means consist of a body of resilient material arranged to be compressed by said pull rods.

10. A support device according to claim 8, in which said pull rods in each said pair thereof are pivoted to the associated lever at points that are respectively at different distances above and below said axis on said frame.

11. A support device according to claim 8, in which said pull rods in each pair thereof are pivoted to the associated lever respectively at an upper point and a lower point which is at a smaller distance from said axis than said upper points.

12. A support device according to claim 8, comprising pivotal connecting means interposed between each said lever and at least one of said pull rods in the pair thereof associated with the lever whereby the distance between said axis of the lever and the pivoted connection between said one of said rods and said lever can be adjusted.

13. A support device according to claim 7, in which each said lever arrangement comprises two substantially parallel levers respectively pivoted about two axes on said frame and in which said force transmission elements in each pair thereof are pull rods pivoted to the levers in the associated pair thereof with one said rod pivoted to one lever in said pair of levers above the pivot of that lever and the other rod in said pair of rods pivoted to the other lever in said pair of levers below the pivot of that lever.

14. A support device according to claim 7, in which said force transmission elements are arranged to act only in tension.

15. A support device according to claim 7, in which said spring means comprise abutment means fixed on said frame and compression spring devices bearing on said abutment means, and in which said force transmission elements comprise rods extending from said lever arrangements and passing through apertures in said compression spring devices and stop means adjustably mounted on said rods to bear on said compression spring means at locations opposed to said abutment means.

16. A support device according to claim 7, in which said force transmission elements are detachably connected to said lever arrangements.

17. A support device according to claim 7, in which said spring means are located so as to lie approximately in the instep zone of the ski boot.

18. A support device to claim 1, in which each said lever is adjustable in length.

19. A support device for the shank of a skier's leg, comprising a frame adapted to be fixed with respect to a ski and to extend on opposite sides of a ski boot, two lever arrangements respectively pivoted to opposite sides of said frame in positions to extend along opposite sides of the skier's shank approximately parallel thereto, said lever arrangments being independently pivoted about axes approximately at the height of the skier's ankle for said lever arrangements to swing forwardly and backwardly with respect to the length of the ski, means for securing said lever arrangements to the skier's shank in the calf region thereof, and spring means for opposing swinging movement of said lever arrangements both forwardly and backwardly with respect to a zero position, said spring means comprising separate spring devices associated respectively with said two lever arrangements so as to permit substantially independent pivotal movement thereof.

* * * * *